US010029771B2

(12) United States Patent
Kim

(10) Patent No.: US 10,029,771 B2
(45) Date of Patent: Jul. 24, 2018

(54) FLOATING RECOVERY DEVICE FOR UNDERWATER EQUIPMENT

(71) Applicant: Ki Joon Kim, Jeju-si (KR)

(72) Inventor: Ki Joon Kim, Jeju-si (KR)

( * ) Notice: Subject to any disclaimer, the term of this patent is extended or adjusted under 35 U.S.C. 154(b) by 0 days.

(21) Appl. No.: 15/458,291

(22) Filed: Mar. 14, 2017

(65) Prior Publication Data

US 2018/0118313 A1 May 3, 2018

(30) Foreign Application Priority Data

Oct. 28, 2016 (KR) ..... 10-2016-0141854
Feb. 23, 2017 (KR) ..... 10-2017-0024080

(51) Int. Cl.
*B63B 22/12* (2006.01)
*B63C 7/26* (2006.01)

(52) U.S. Cl.
CPC ..... *B63C 7/26* (2013.01); *B63B 2203/00* (2013.01); *B63B 2207/00* (2013.01)

(58) Field of Classification Search
CPC ..... B63B 2203/00; B63B 2207/00; B63B 2207/02; B63B 2207/04; B63B 2738/00; B63B 2738/02; B63B 2738/08; B63B 2738/12; B63C 7/26
USPC ..... 114/312, 322, 244, 245, 343, 345, 121, 114/123; 441/1, 2, 6, 9, 30, 32
See application file for complete search history.

(56) References Cited

U.S. PATENT DOCUMENTS 4,055,138 A * 10/1977 Klein ..... B63B 21/66 114/244
6,390,012 B1 * 5/2002 Watt ..... B63B 27/36 114/322

FOREIGN PATENT DOCUMENTS

KR 200271251 U 4/2002
KR 100952995 B1 4/2010
KR 101472828 B1 12/2014
KR 101526908 B1 6/2015
KR 20150059334 A 6/2015

OTHER PUBLICATIONS

Korean Office Action dated Nov. 28, 2016 issued regarding KR20150059334A.

(Continued)

*Primary Examiner* — Daniel V Venne
(74) *Attorney, Agent, or Firm* — Harness, Dickey & Pierce, P.L.C.

(57) ABSTRACT

Disclosed herein is a floating recovery device for underwater equipment. The device includes a recovery body partitioned into a first compartment, a second compartment, and a third compartment by a partition wall, first and second pressure tanks installed in the first and second compartments, respectively, first and second striking parts fastened to the first and second pressure tanks, respectively, to strike the first and second pressure tanks, first and second actuators wirelessly actuating the first and second striking parts, respectively, and a buoyancy generator installed in the third compartment, and inflated by high-pressure gas introduced from the first and second pressure tanks, thus generating buoyancy. Such a configuration allows the pressure tank to be wirelessly struck for the purpose of supplying high-pressure gas to the buoyancy generator and floating the underwater equipment in the event of the loss of the underwater equipment.

13 Claims, 15 Drawing Sheets

(56) References Cited

OTHER PUBLICATIONS

Korean Office Action dated Mar. 10, 2017 issued regarding KR20150059334A.

* cited by examiner

FLOATING RECOVERY DEVICE FOR UNDERWATER EQUIPMENT

CROSS-REFERENCE TO RELATED APPLICATIONS

This application claims priority to Korean Patent Application Nos. 10-2016-0141854 and 10-2017-0024080, filed on Oct. 28, 2016, and Feb. 23, 2017 respectively, the disclosures of which are incorporated herein by reference in their entirety.

BACKGROUND OF THE INVENTION

Field of the Invention

Exemplary embodiments of the present invention relate to a floating recovery device for underwater equipment, and more particularly, to a floating recovery device for underwater equipment, which is capable of floating the underwater equipment by wirelessly operating a gas striking part of a buoyancy generator in the event of the loss of expensive underwater equipment.

Description of the Related Art

Generally, expensive marine surveying equipment has been employed to conserve marine environment and develop ocean. As the most basic expensive equipment for marine environment research, a conductivity temperature depth profiler, a multi-beam side scan sonar, underwater imaging equipment, a video camera, a hydrometer, a wave-height meter, an unmanned underwater vehicle (ROV), and other expensive underwater surveying equipment are utilized.

Such marine surveying equipment is connected to a wire or a rope. However, the marine surveying equipment may be accidentally dropped from a vessel to the sea, the underwater imaging equipment may be dropped into the sea while it is pulled up onto the vessel after taking a picture underwater or due to careless management, or the equipment may be missed and lost in a region where tidal current is strong.

In order to find the lost expensive equipment, a diver may be dived to the sea. However, the diver cannot reach deep sea and cannot find the lost equipment in a place where visibility is low, thus resulting in an economic loss. That is, this is problematic in that the marine surveying equipment is very expensive but is not equipped with a particular safety device so as to prevent a loss.

SUMMARY OF THE INVENTION

An object of the present invention is to provide a floating recovery device for underwater equipment, in which a pressure tank is wirelessly struck when the expensive underwater equipment is lost in the water, thus allowing the underwater equipment to be floated on the surface of water.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a floating recovery device for underwater equipment includes a recovery body partitioned into a first compartment, a second compartment, and a third compartment by a partition wall; first and second pressure tanks installed in the first and second compartments, respectively; first and second striking parts fastened to the first and second pressure tanks, respectively, to strike the first and second pressure tanks; first and second actuators wirelessly actuating the first and second striking parts, respectively; and a buoyancy generator installed in the third compartment, and inflated by high-pressure gas introduced from the first and second pressure tanks, thus generating buoyancy.

The first actuator may include a first transmitter wirelessly sending an actuating signal in response to a user's operation; a first receiver provided in the first compartment to receive a signal from the first transmitter; a first controller receiving a signal from the first receiver; and a first power supply driven by the first controller to supply electric power to the first striking part and thereby actuate the first striking part.

The second actuator may include a second transmitter wirelessly sending an actuating signal in response to a user's operation; a second receiver provided in the second compartment to receive a signal from the second transmitter; a second controller receiving a signal from the second receiver; a second power supply driven by the second controller; a lighting part supplied with electric power from the second power supply to emit light; and a light sensor detecting light emitted from the lighting part and transmitting a signal to the second controller, wherein the second controller may control the second power supply in response to the signal transmitted from the light sensor, thus supplying electric power to the second striking part and thereby actuating the second striking part.

The recovery body may include a seal inserted into a sealing groove formed in tops of the first compartment, the second compartment, and the third compartment; and a recovery cover fastened to a top of the recovery body to compress the seal.

The recovery body may include a buoyancy generating outlet formed through a sidewall of the third compartment; a withdrawal door fastened to the third compartment via a hinge to open or close the buoyancy generating outlet; and a support spring connecting the withdrawal door with a support protrusion formed in the third compartment, and applying an elastic force to cause the withdrawal door to be closed.

The striking part may include a striking body fastened at a first side thereof to the pressure tank; a striking head disposed in the first side of the striking body, with a guide groove being formed in the striking head; a striking pin inserted into the guide groove of the striking head to rectilinearly move, and striking a blocking member of the pressure tank; a safety spring disposed between the guide groove and the striking pin, and applying an elastic force so that the striking pin is spaced apart from the blocking member; a pushing link moving the striking pin to strike the blocking member of the pressure tank; and a solenoid part driving the pushing link.

The solenoid part may include a housing provided in a second side of the striking body; a rod slidably disposed in the housing, and connected with the pushing link to actuate the pushing link; a coil disposed to surround the rod, and generating a magnetic field to slidably move the rod if electric power is applied thereto; and a spring disposed between the housing and the rod, and applying an elastic force such that the rod actuates the pushing link and returns the pushing link to an original position thereof.

The striking part may include an adapter fastened to an inlet of the pressure tank; a striking member slidably inserted into the adapter, and striking the blocking member of the pressure tank; and a striking means fastened to the adapter, and moving the striking member to strike the blocking member of the pressure tank.

The adapter may be fastened at a first side thereof to the inlet of the pressure tank and may be fastened at a second side thereof to the striking means, and a striking member slit may be formed in a center of the adapter to allow the striking member to be movably inserted therein.

The adapter may further include a spraying part spraying gas, jetted when the striking member strikes the blocking member of the pressure tank, to an outside.

The striking means may include an elastic part having an elastically moving cylinder; a strike transfer member slidably inserted into the elastic part, and triggered by the elastic part, thus striking and moving the striking member; and a trigger part disposed between the elastic part and the adapter, pressurizing and constraining the strike transfer member so that the strike transfer member elastically compresses the cylinder, and optionally actuated to release a constraining force from the strike transfer member.

The elastic part may include an elastic-part body having a hollow portion, and opened at a first side thereof; a cap member fastened at a first side thereof to the open first side of the elastic-part body, and fastened at a second side thereof to a first side of the trigger part, with a strike-transfer-member slit being formed in a center of the cap member to allow the strike transfer member to be movably inserted therein; a cylinder slidably disposed in the elastic-part body, a protrusion protruding from a first side of the cylinder to be inserted into the strike-transfer-member slit of the cap member; and an elastic member disposed between the elastic-part body and the cylinder, and applying an elastic force so that the cylinder moves towards the cap member.

The trigger part may include a trigger-part body penetrated at a center thereof, fastened at a first side thereof to the elastic part and fastened at a second side thereof to the adapter; a rotary member rotatably inserted into and fastened to the trigger-part body to be perpendicular to the strike transfer member, with a through hole formed in the rotary member so that the strike transfer member passes therethrough; and a drive motor provided in the trigger-part body to rotate the rotary member.

The striking means may include a housing fastened to the adapter; a power transfer member rotatably inserted into and fastened to the housing to be perpendicular to the striking member, and having a second gear that engages with a first gear formed on the striking member to rectilinearly move the striking member; and a drive motor provided in the housing to rotate the power transfer member.

The floating recovery device may further include a controller actuating the drive motor of the striking means if a strike command is input thereto.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
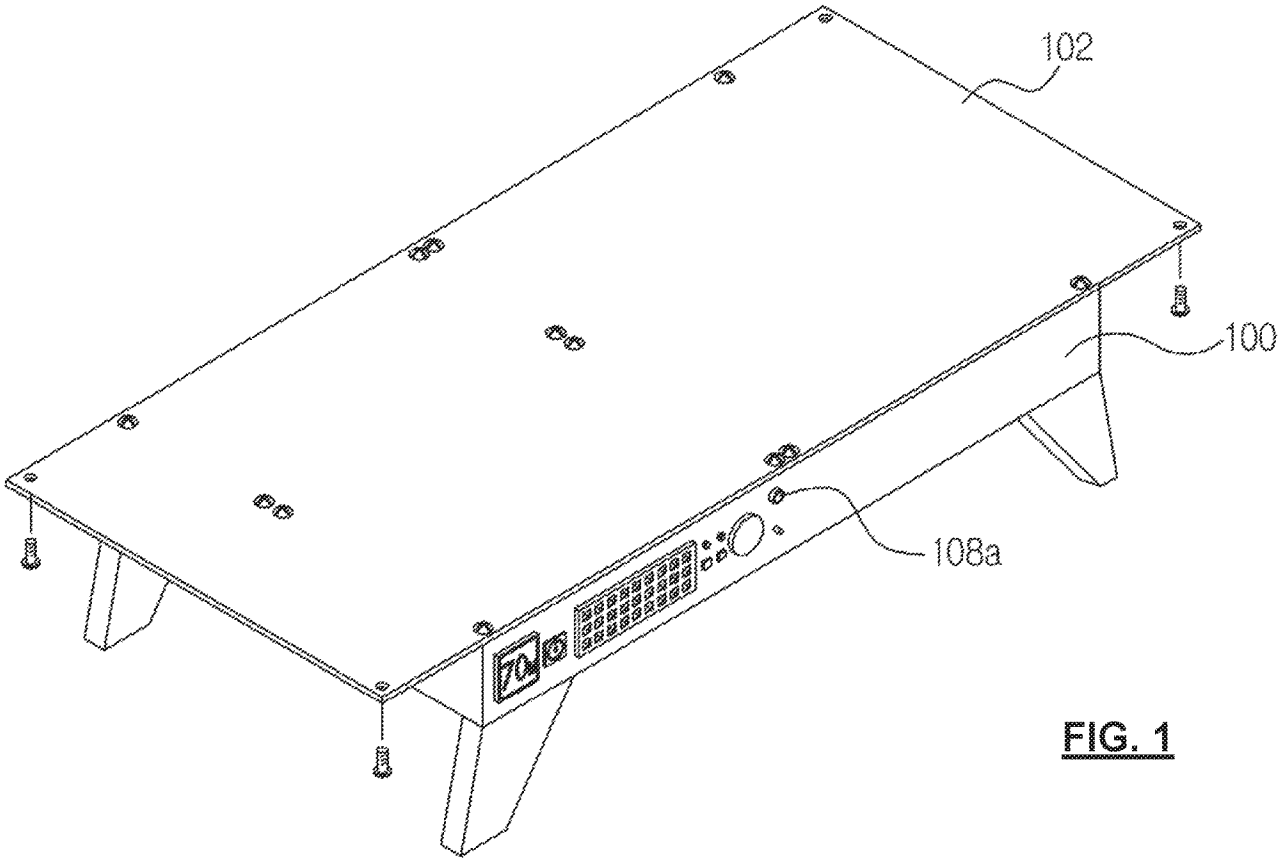
FIG. 1 is a perspective view schematically illustrating a floating recovery device for underwater equipment according to an embodiment of the present invention.

In order to assist in understanding the features of the present invention, a floating recovery device for underwater equipment according to the embodiment of the present invention will be described below in detail.

It should be noted that the same reference numerals denote the same elements throughout different drawings. The description of known functions or configurations will be omitted herein to make the gist of this invention clear.

Embodiments of the present invention will be described below in detail with reference to the accompanying drawings.

Figure 2:
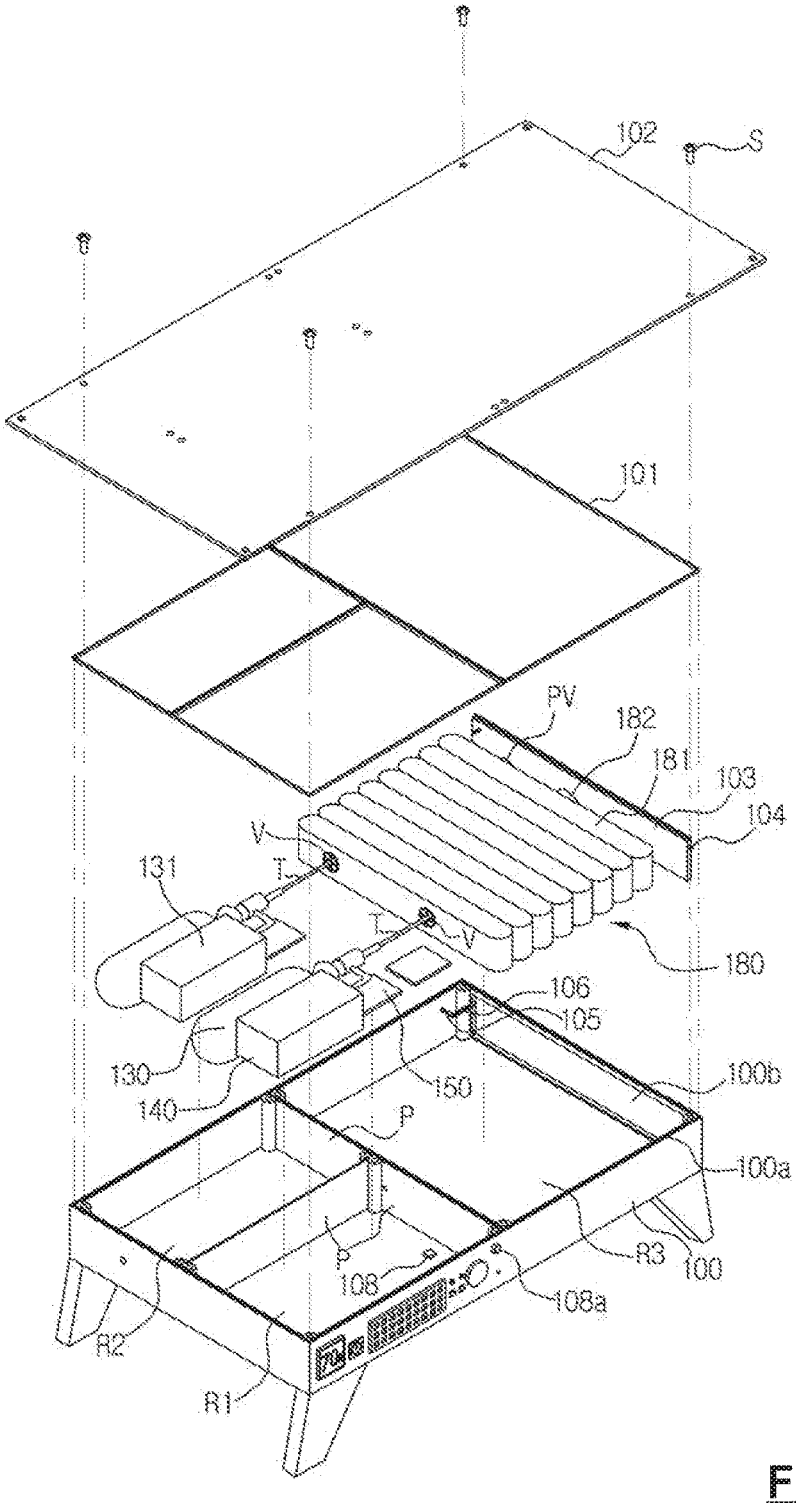
FIG. 2 is an exploded perspective view schematically illustrating the floating recovery device for the underwater equipment according to the embodiment of the present invention.
Figure 3:
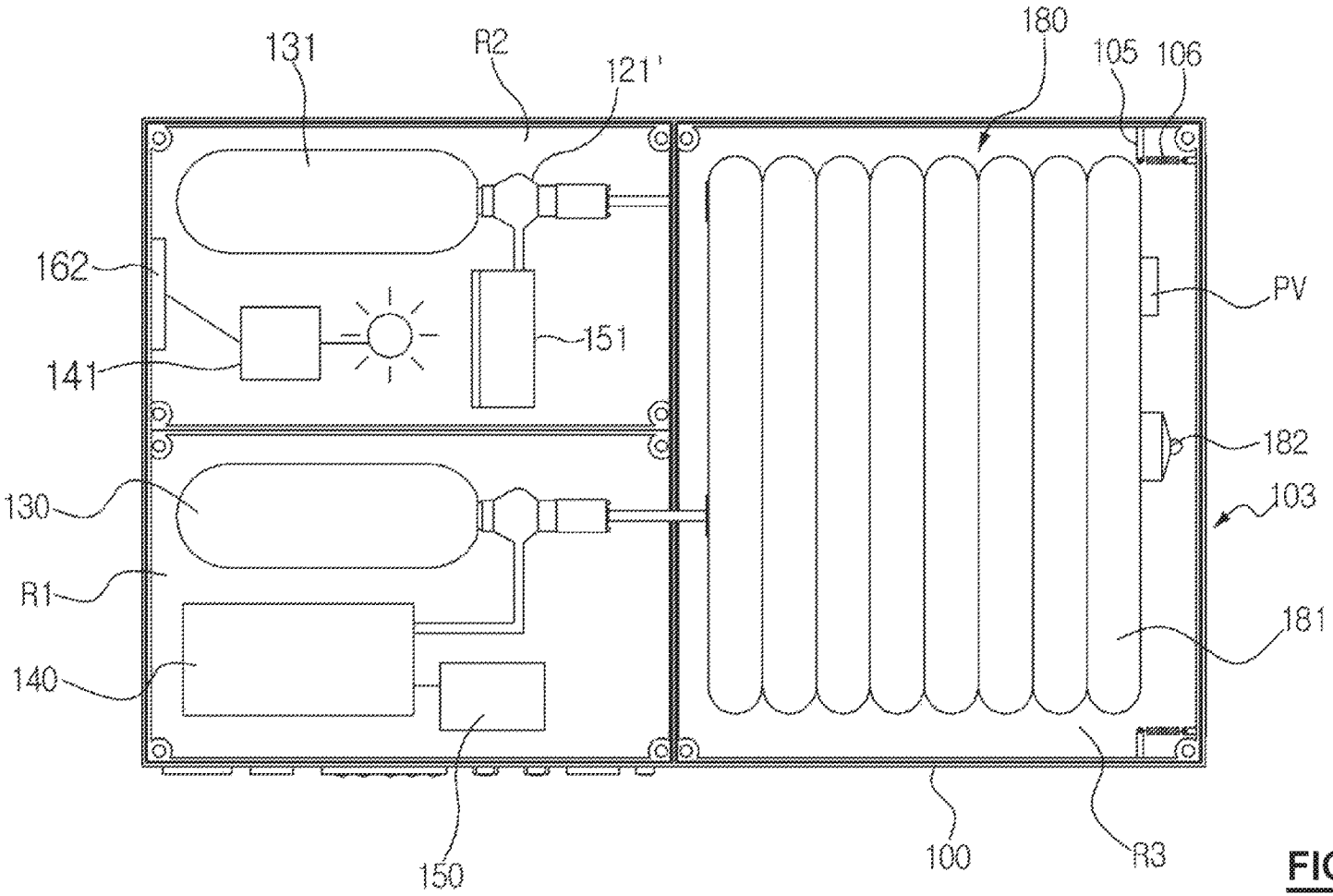
FIG. 3 is a plan view schematically illustrating the floating recovery device for the underwater equipment according to the embodiment of the present invention.
Figure 4:
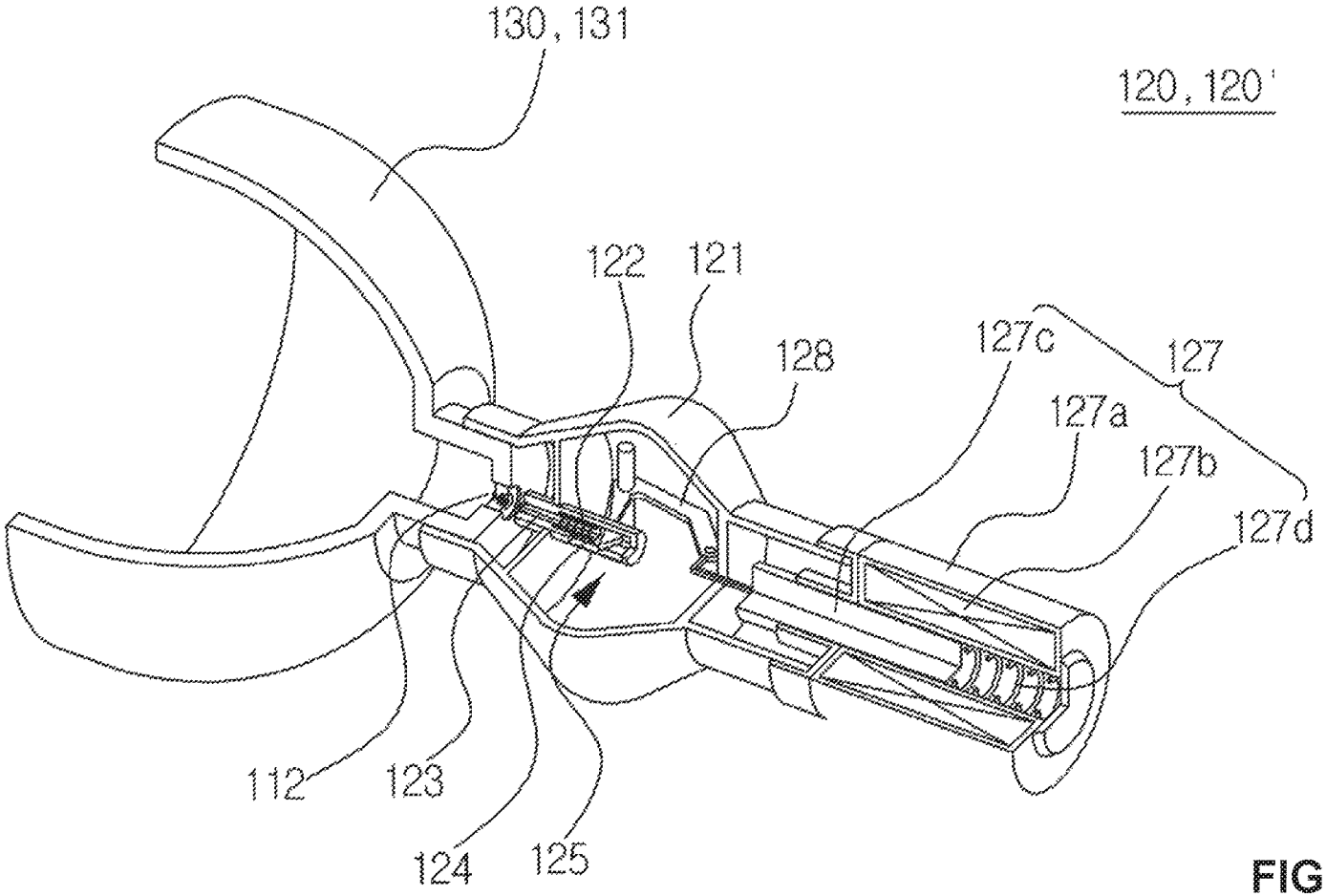
FIG. 4 is an extracted sectional view schematically illustrating a striking part of the floating recovery device for the underwater equipment according to the embodiment of the present invention.
Figure 5:
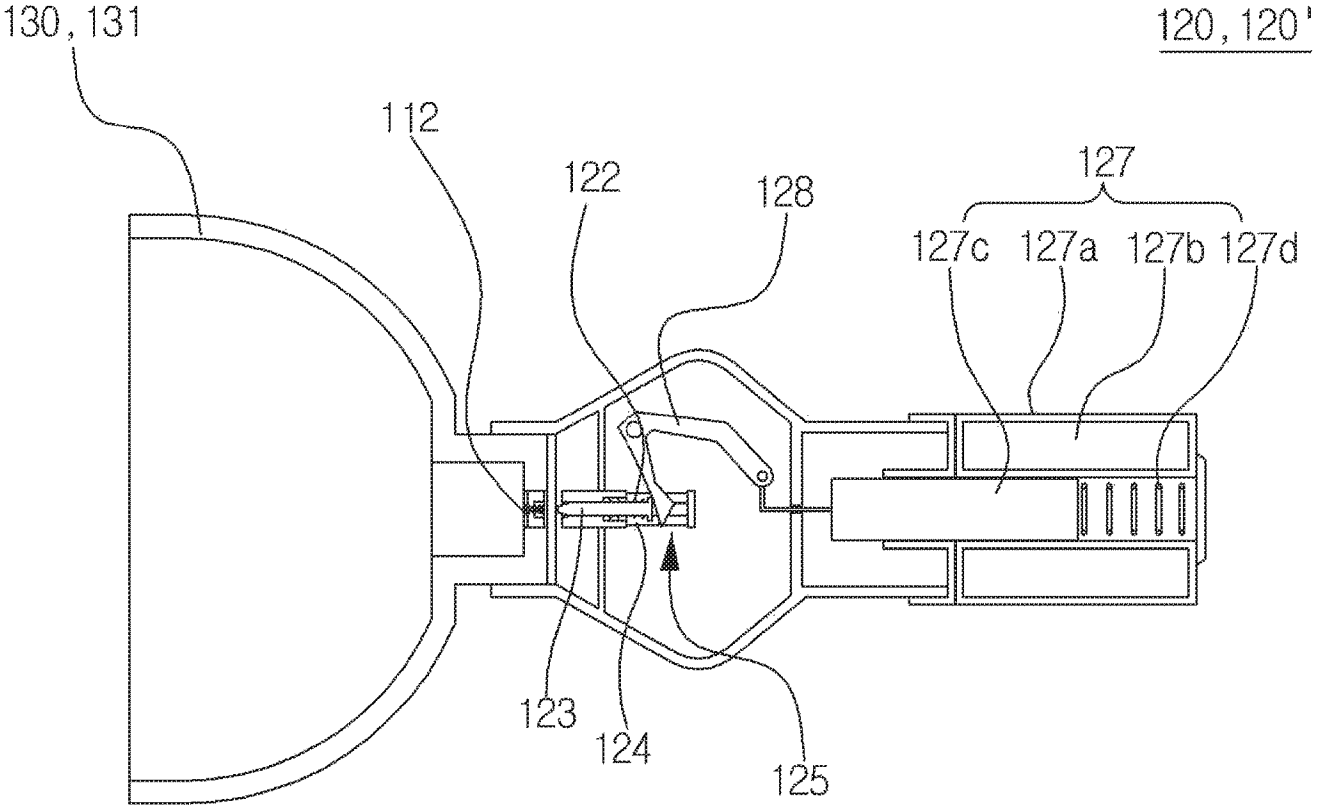
FIG. 5 is an extracted cutaway perspective view schematically illustrating the striking part of the floating recovery device for the underwater equipment according to the embodiment of the present invention.
Figure 6:
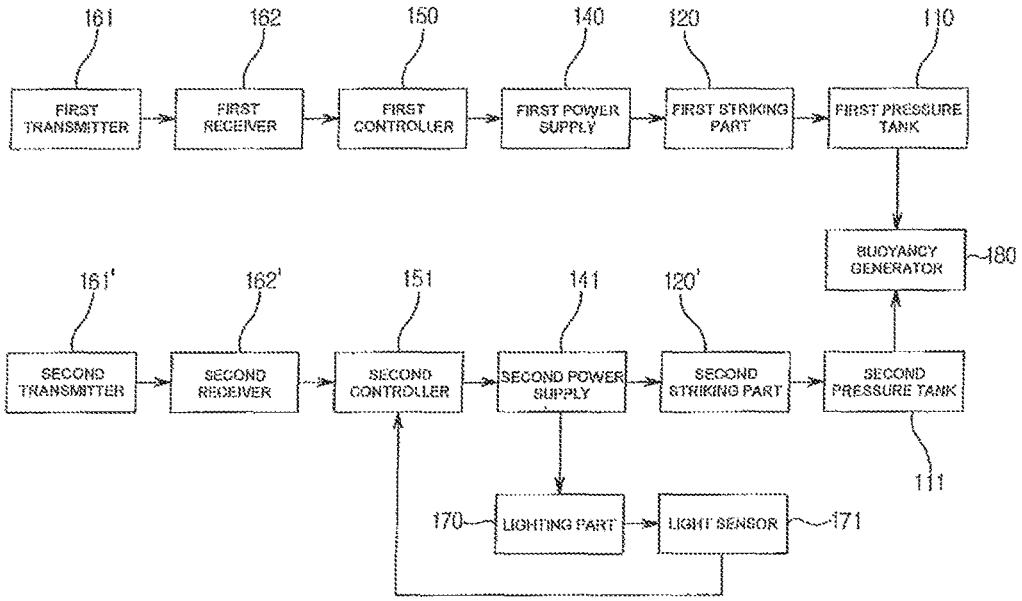
FIG. 6 is a block diagram schematically representing the floating recovery device for the underwater equipment according to the embodiment of the present invention.

FIGS. 1 and 2 are a perspective view and an exploded perspective view schematically illustrating a floating recovery device for underwater equipment according to an embodiment of the present invention, and FIG. 3 is a plan view schematically illustrating the floating recovery device for the underwater equipment. FIGS. 4 and 5 are an extracted sectional view and an extracted cutaway perspective view schematically illustrating a striking part of the floating recovery device for the underwater equipment. FIG. 6 is a block diagram schematically representing the floating recovery device for the underwater equipment.

Referring to FIGS. 1 to 6, the floating recovery device for the underwater equipment according to the embodiment of the present invention includes a recovery body 100, first and second pressure tanks 110 and 111, first and second striking parts 120 and 120', first and second actuators, and a buoyancy generator 180.

Here, the recovery body 100 defines a predetermined space therein to be isolated from an outside, and is preferably made of a material that is resistant to external shock and is good in water-tightness, for example, strong aluminum or polycarbonate.

The recovery body 100 is configured such that an internal space thereof is partitioned to three compartments, namely, a first compartment R1, a second compartment R2, and a third compartment R3 by a plurality of partition walls P. Further, a holding member may be formed on an edge of the recovery body 100 to allow it to be easily coupled with a recovery cover 102.

The recovery body 100 has a sealing groove 100*a* on tops of the first compartment R1, the second compartment R2, and the third compartment R3, and a seal 101 is inserted into the sealing groove 100*a* so as to maintain water-tightness. The seal 101 is compressed by the recovery cover 102 that covers the top of the recovery body 100 and is fastened thereto via screws S.

A buoyancy generating outlet 100*b* is provided on a sidewall of the third compartment R3 of the recovery body 100, and a withdrawal door 103 is rotatably fastened to the buoyancy generating outlet 100*b* via a hinge 104 to be opened or closed. Further, the buoyancy generating outlet 100*b* is normally kept closed by the withdrawal door 103 using a support spring 106 connecting the withdrawal door 103 with a support protrusion 105 formed in the third compartment R3.

The first compartment R1 is a predetermined space that is formed by partitioning the interior of the recovery body 100 using the partition wall P. In the first compartment R1, a first pressure tank 130 to which the first striking part 120 is fastened, a first power supply 140 for driving the first striking part 120, and a first controller 150 for controlling the first power supply 140 are provided. Further, a first receiver 162 of the actuator that will be described below is provided on an outer surface of the first compartment R1.

Furthermore, the first pressure tank 130 provided in the first compartment R1 is configured to deliver high-pressure gas, which is struck and stored by driving the first striking part 120, to the buoyancy generator 180 provided in the third compartment R3. In this regard, the first striking part 120 is actuated by operating a smart device or a separate wireless remote controller. That is, if a worker operates the wireless remote controller to transmit a wireless signal from a first transmitter 161, a first receiver 162 provided in the first compartment R1 receives the wireless signal and then sends the signal to the first controller 150. At this time, the first controller 150 controls the first power supply 140 to drive the first striking part 120 and thereby strike the first pressure tank 130.

The second compartment R2 is formed by partitioning the interior of the recovery body 100 using the partition wall P. In the second compartment R1, a second pressure tank 131 to which a second striking part 120' is fastened, a second power supply 141 for driving the second striking part 120', a second controller 151 for controlling the second power supply 141 and the second striking part 120', a second receiver 161' that is provided outside the second compartment R2 and receives a wireless signal to send the signal to the second controller 151, a lighting part 170 that emits light if the second controller 151 receives the wireless signal, and a light sensor 171 that detects light of the lighting part 170 are provided.

If a worker operates the wireless remote controller to transmit the wireless signal from the second transmitter 161', the second receiver 162' provided in the second compartment R2 receives the wireless signal and sends the signal to the second controller 151. At this time, if the second controller 151 controls the second power supply 141 to apply power to the lighting part 170 and thereby emit light, the light sensor 171 detects emitted light and sends a detected signal to the second controller 151. Then, the second controller 151 drives the second striking part 120' to strike the second pressure tank 131.

The first and second pressure tanks 130 and 131 are filled with high-pressure gas, and supply high-pressure gas to the buoyancy generator 180 provided in the third compartment R3 when the tanks are struck, respectively, by the first and second striking parts 120 and 120' that will be described below. In this regard, the pressure tank may be provided as a $CO_2$ cartridge filled with $CO_2$ at high pressure.

The first and second striking parts 120 and 120' are configured to strike the first and second pressure tanks 130 and 131 and thereby spray high-pressure gas stored in the pressure tanks. The first and second striking parts have the same configuration.

In each of the first and second striking parts 120 and 120', a striking head 125 with a guide groove 124 having a striking pin 123 over which a safety spring 122 is fitted is coupled to one side of the striking body 121, so that the striking pin 123 is normally held in the striking body 121 by an elastic force of the safety spring 122.

A solenoid part 127 having a coil 127*b*, a spring 127*d* and a rod 127*c* in a housing 127*a* is coupled to the other side of the striking body 121.

The coil 127*b* of the solenoid part 127 is connected to the first and second power supplies 140 and 141 that supply power. The first and second controllers 150 and 151 control the first and second power supplies 140 and 141 to supply power to the coil 127*b* and thereby actuate the solenoid part.

The rod 127*c* abuts on one side of a pushing link 128, and the other side of the pushing link 128 is inserted into the guide groove 124 to abut on the striking pin 123. Here, if power is applied to the coil 127*b* and simultaneously the rod 127*c* is pulled out to press one side of the pushing link 128, the other side moves along the guide groove 124, pushes the striking pin 123, and compresses the safety spring 122 to be exposed to an outside of the striking body 121. Thus, a blocking member 112 provided in each of the first and second compartments R1 and R2 is pressed, so that each compartment is opened and high-pressure gas is ejected out from each of the first and second pressure tanks 110 and 111.

The blocking member 112 is coupled to an inlet side of each of the first and second pressure tanks 110 and 111 into which the high-pressure gas is injected, thus normally preventing the high-pressure gas from leaking out.

Meanwhile, each of the first and second compartments R1 and R2 has a water leak detector 108 to check the leakage of water and thereby take necessary measures. A water leak display 108*a* is provided on an outside of each of the first and second compartments R1 and R2 to display the state of the water leak detector 108.

The third compartment R3 is partitioned from the first compartment R1 and the second compartment R2 by the partition wall P, and the buoyancy generator 180 is provided in the third compartment R3 to be inflated by the high-pressure gas of the first pressure tank 110 or the second pressure tank 111.

Such a buoyancy generator 180 has a sealed inflation member 181 that is folded and stored to be arranged in a zigzag fashion. The inflation member 181 is connected at one side thereof to a feeding tube T that is connected to the first pressure tank 110, via a check valve V.

A flash lamp 182 and an overpressure prevention valve PV are provided on the other side of the inflation member 181. The flash lamp 182 allows a user to easily check a location even in a foggy daytime or at night in the state where the inflation member 181 floats on the surface of water. Further, the overpressure prevention valve PV allows gas expanded in the inflation member 181 to be discharged to an outside. As the floating recovery device for the underwater equipment floats from a deep location having high water pressure, pressure is in inverse proportion to volume, so that the overpressure prevention valve PV prevents explosion due to inflation.

The inflation member 181 is made of any one of thermoplastic urethane, compressed PVC fabric and compressed polyurethane that are resistant to pressure of the high-pressure gas or external shock, thus preventing damage while buoyancy is generated.

The first power supply 140 is configured to apply power to the first striking part 120 as well as the first controller 150, a counting part, a display part, a setting part and an initialization part, while causing the flash lamp 182 of the buoyancy generator 180 to be turned on or off.

Here, the flash lamp 182 itself may be integrated with the power supply to be automatically actuated by the power supply.

In the present invention, a simple power supply is provided to supply power to respective components. However, in addition to such a structure, it is possible to use the device for a lengthy period of time by using solar energy.

To this end, a solar module may be provided on the recovery cover 102 coupled to the top of the recovery body 100 to enable the application of electric current by a charge and discharge controller, thus allowing power to be stably supplied for a lengthy period of time.

The first and second actuators include first and second transmitters 161 and 161' that are provided in an electronic device operable by a user, such as a remote controller, a mobile phone or a tablet, to generate a signal, and first and second receivers 162 and 162' that are connected to the first and second controllers 150 and 151 to receive the signal from the first and second transmitters 161 and 161' and thereby send the signal to the first and second controllers 150 and 151.

Here, the first and second controllers 150 and 151 are configured to supply power to the coil 127*b* of the solenoid part 127 and thereby actuate the respective striking parts 120 and 120' if the signal is sent from the respective receivers 162 and 162'.

For example, the first and second transmitters 161 and 161' and the first and second receivers 162 and 162' of the first and second actuators are configured to perform wireless communications using Bluetooth, so that the first and second transmitters 161 and 161' may be used by activating a Bluetooth function in a user's mobile phone. Before he or she enters the water while possessing the underwater equipment, the wireless receiving function of the first and second receivers 162 and 162' is activated through the first and second controllers 150 and 151 that are provided, respectively, in the first and second compartments R1 and R2 of the recovery body 100.

Figure 7:
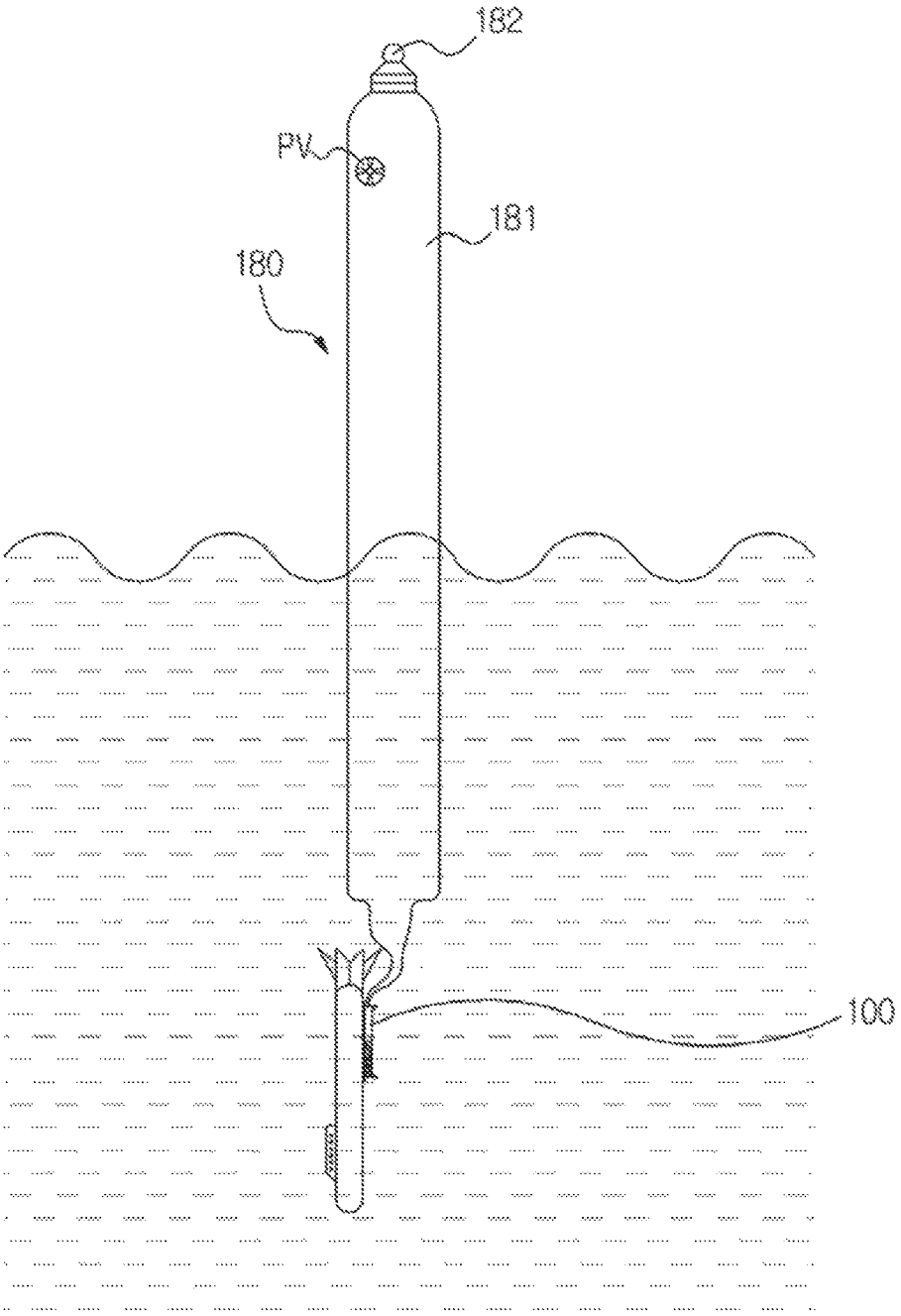
FIG. 7 is view schematically illustrating a state in which the floating recovery device for the underwater equipment according to the embodiment of the present invention is mounted on a side scan sonar that is an underwater search sonar and floats on the surface of water by buoyancy.
Figure 8:
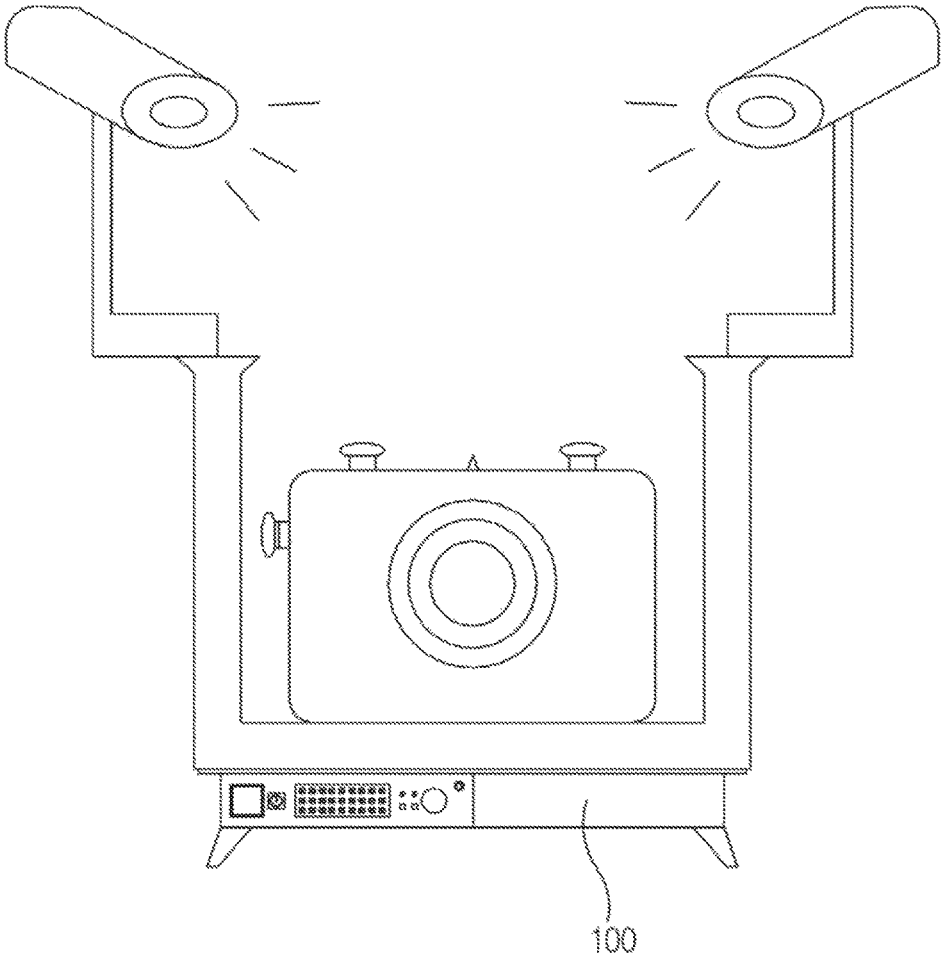
FIG. 8 is a view schematically illustrating a state in which the floating recovery device for the underwater equipment according to the embodiment of the present invention is mounted on underwater imaging equipment.
Figure 9:
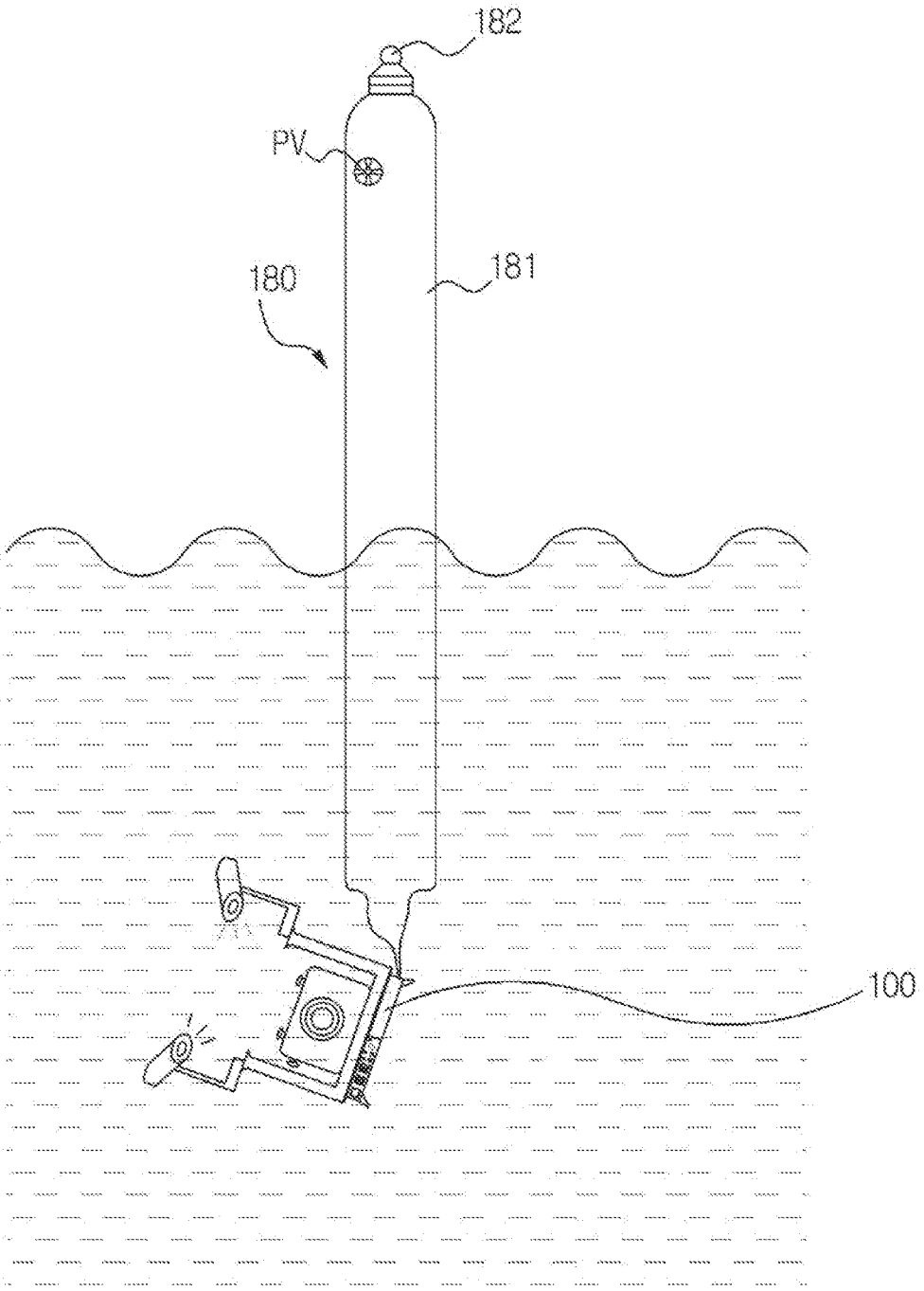
FIG. 9 is a view schematically illustrating a state in which the floating recovery device for the underwater equipment according to the embodiment of the present invention is mounted on the underwater imaging equipment and floats on the surface of water by buoyancy.

FIG. 7 is view schematically illustrating a state in which the floating recovery device for the underwater equipment according to the embodiment of the present invention is mounted on a side scan sonar that is an underwater search sonar and floats on the surface of water by buoyancy, and FIGS. 8 and 9 are views schematically illustrating a state in which the floating recovery device for the underwater equipment is mounted on underwater imaging equipment, and a state in which the floating recovery device floats on the surface of water by buoyancy.

As illustrated in FIG. 7, when the floating recovery device for the underwater equipment according to the embodiment of the present invention is mounted on the side scan sonar that is the underwater search sonar, if the floating recovery device for the underwater equipment is actuated in the event of a loss, the floating recovery device is floated on the surface of water by the buoyancy of the buoyancy generator 180, so that a user may easily find the lost device.

An operation will be described in detail with reference to FIGS. 8 and 9, in the state where the floating recovery device for the underwater equipment according to the embodiment of the present invention is mounted on the underwater imaging equipment. If the floating recovery device for the underwater equipment mounted on the underwater imaging equipment drops to the bottom of the water, a user operates the first transmitter 161 of a wireless transmitter provided in the remote controller to actuate the first striking part 120 of the first compartment R1. That is, he or she operates the mobile phone, the tablet or the like having a wireless remote control or wireless transmission function in a vessel.

Then, the first receiver 162 provided in the first compartment R1 receives a signal from the first transmitter 161 of the wireless remote controller and then sends the signal to the first controller 150. Then, the first controller 150 controls the first power supply 140 to apply power to the coil 127*b* of the first striking part 120. Then, the rod 127*c* is pulled out from the housing 127*a* by a magnetic force generated in the coil 127*b*, presses one side of the pushing link 128, and subsequently, the other side of the pushing link 128 moves along the guide groove 124, pushes the striking pin 123 and compresses the safety spring 122, thus making it be exposed to an outside of the striking body 121.

If the striking body is opened while the blocking member 112 is pressed, so that high-pressure gas is fed from the first pressure tank 110 through the feeding tube T into the inflation member 181, the inflation member 181 is inflated and floats on the surface of water. Consequently, it is possible to safely recover the expensive underwater equipment.

Here, unless the underwater imaging equipment floats on the surface of water when a predetermined time has passed after a user operates the first transmitter 161 of the wireless remote controller, the second transmitter 161' of the wireless remote controller is operated.

Then, the second receiver 162' provided in the second compartment R2 receives the signal from the second transmitter 161' of the wireless remote controller and then sends the signal to the second controller 151. Then, the second controller 151 controls the second power supply 141 to apply power to the lighting part 170 and emit light. If the light sensor 171 detects light and transfers a signal to the second controller 151, the second controller 151 controls the second power supply 141 to apply power to the coil 127*b* of the second striking part 120'. Then, the rod 127*c* is pulled out from the housing 127*a* by a magnetic force generated in the coil 127*b*, presses one side of the pushing link 128, and subsequently, the other side of the pushing link 128 moves along the guide groove 124, pushes the striking pin 123 and compresses the safety spring 122, thus making it be exposed to an outside of the striking body 121.

The striking body is opened while the blocking member 112 is pressed, so that high-pressure gas is fed from the second pressure tank 121 through the feeding tube T into the inflation member 181. As the inflation member is inflated and floats on the surface of water through the above-mentioned process, it is possible to safely recover expensive ocean observation equipment and underwater equipment.

Figure 10:
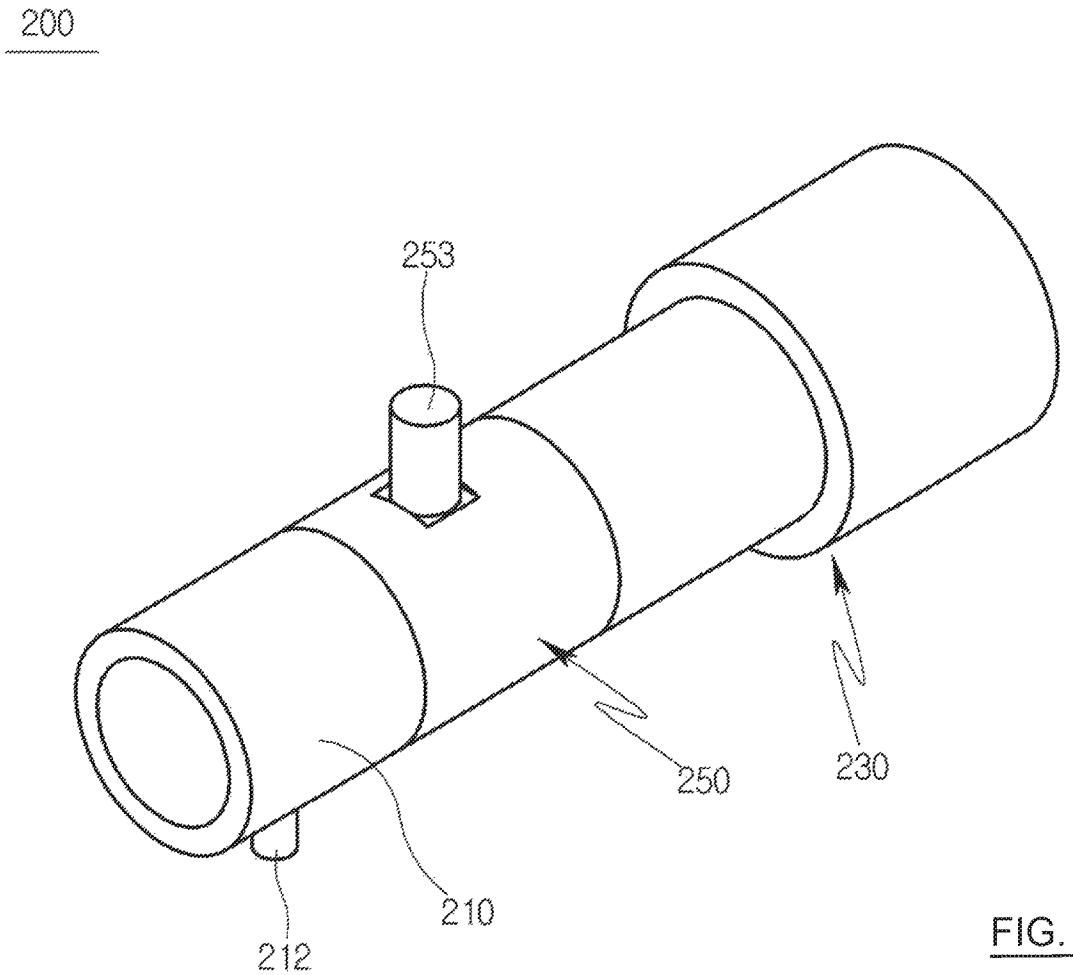
FIG. 10 is a perspective view schematically illustrating another embodiment of a striking part on the floating recovery device for the underwater equipment according to the embodiment of the present invention.
Figure 11:
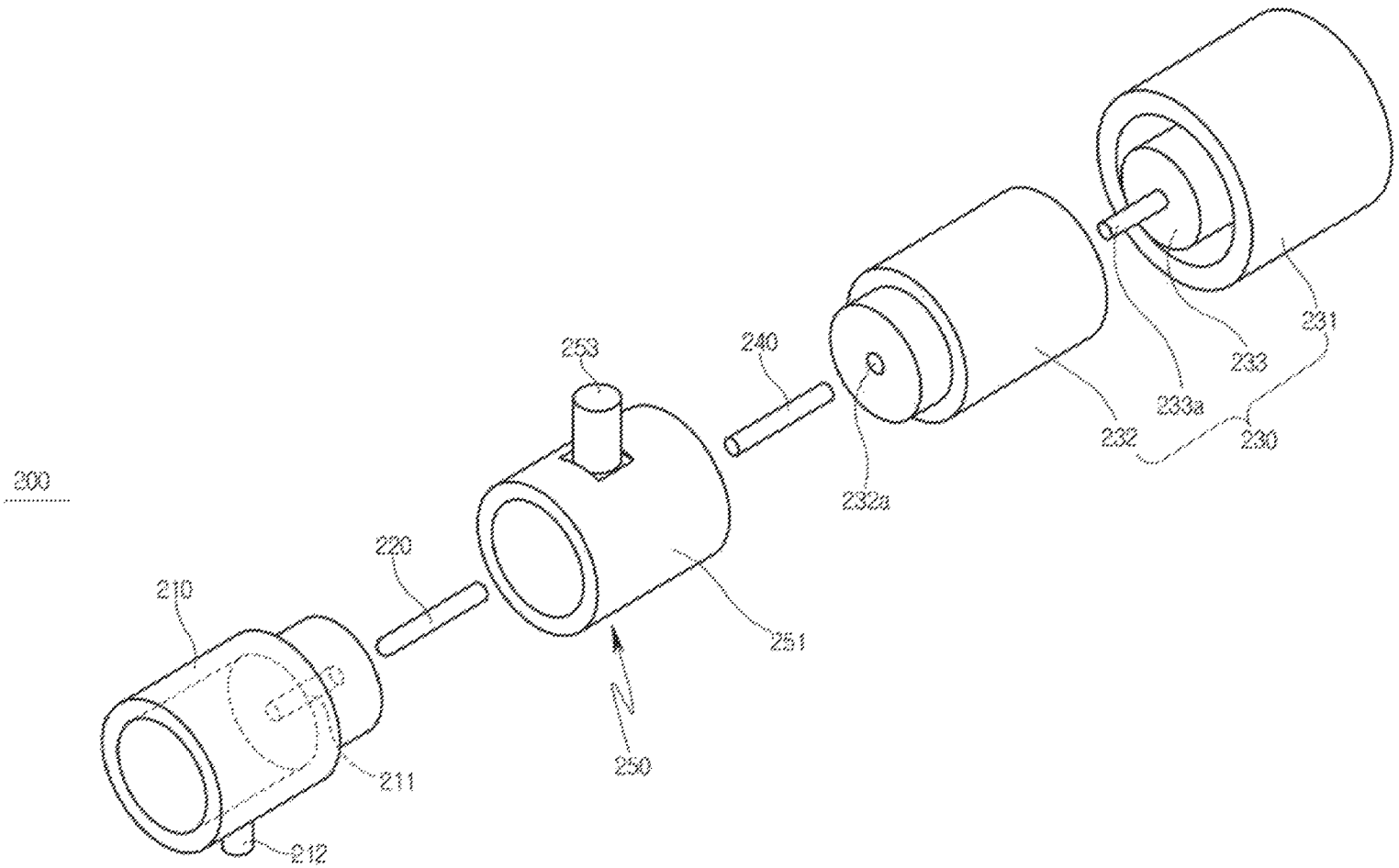
FIG. 11 is an exploded perspective view schematically illustrating another embodiment of the striking part on the floating recovery device for the underwater equipment according to the embodiment of the present invention.
Figure 12:
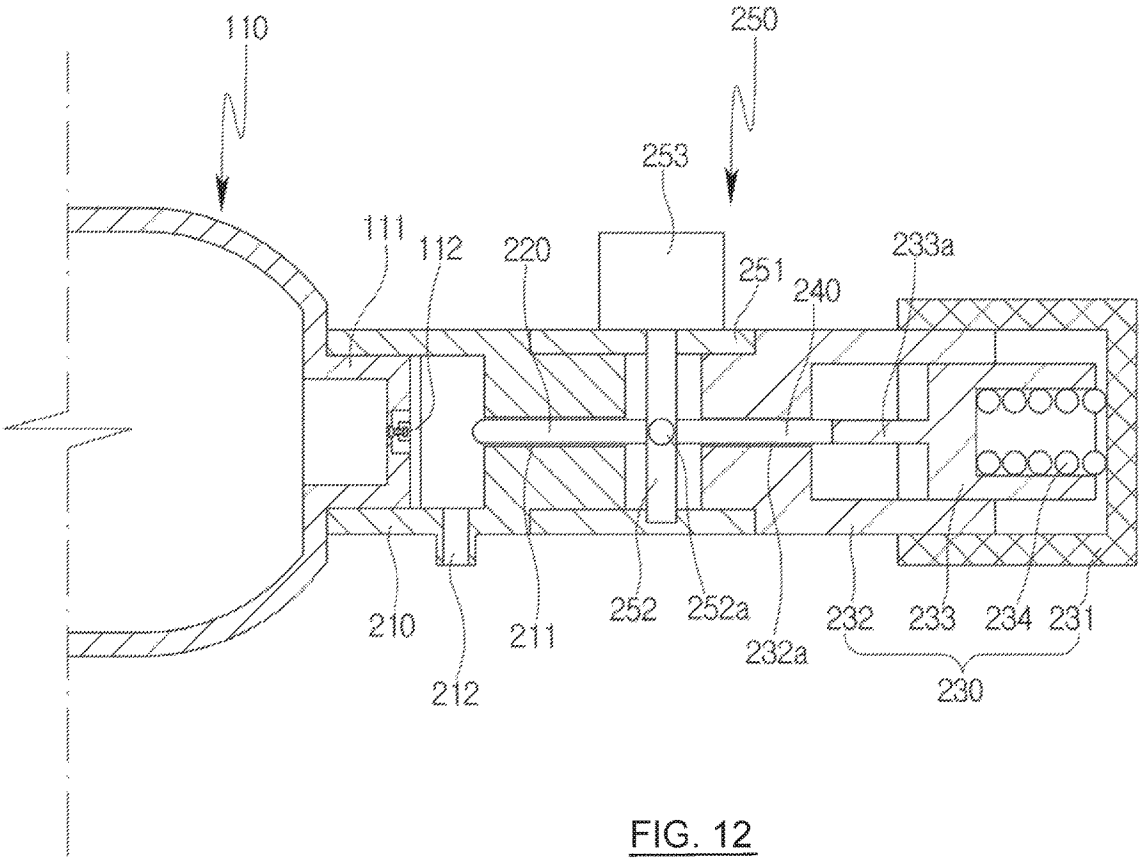
FIG. 12 is a sectional view schematically illustrating a state in which the striking part of the floating recovery device for the underwater equipment according to the embodiment of the present invention is fastened to a pressure tank.
Figure 13:
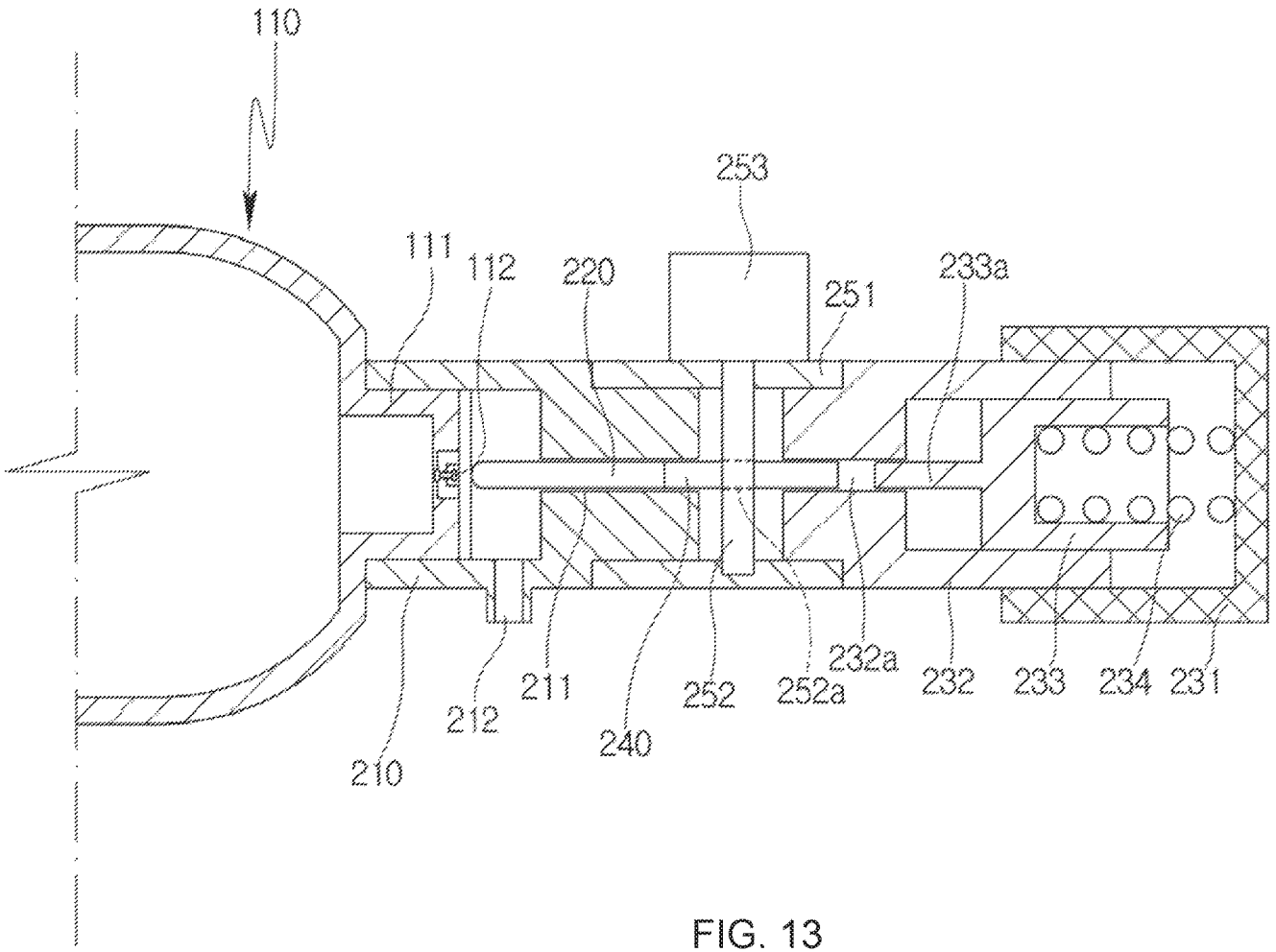
FIG. 13 is a sectional view schematically illustrating a state in which the striking part of the floating recovery device for the underwater equipment according to the embodiment of the present invention is fastened to the pressure tank and then is operated.

FIGS. 10 and 11 are a perspective view and an exploded perspective view schematically illustrating another embodiment of the striking part on the floating recovery device for the underwater equipment, and FIGS. 12 and 13 are sectional views schematically illustrating a state in which the striking part of the floating recovery device for the underwater equipment is fastened to a pressure tank and a state in which the striking part is operated.

Referring to FIGS. 10 to 13, the striking part 200 according to another embodiment of the present invention includes an adapter 310 that is fastened to the inlet 111 of the pressure tank 110 spraying stored high-pressure gas if the blocking member 112 is struck, a striking member 320 that is slidably inserted into the adapter 310 and strikes the blocking member 112 of the pressure tank 110, and a striking means that is fastened to the adapter 310 and moves the striking member 320 to strike the blocking member 112 of the pressure tank 110.

In this regard, the pressure tank 110 stores therein high-pressure gas, as in a $CO_2$ cartridge or the like, and sprays all the high-pressure gas stored therein if the blocking member 112 is struck or pressed.

The adapter 310 is provided in the shape of a cylinder that is penetrated at a center thereof. One side of the adapter 310 is fastened to the inlet 111 of the pressure tank 110, while the other side is fastened to the striking means.

Further, the adapter 310 has at a center thereof a striking member slit 311 so that the striking member 320 is movably inserted into the adapter 310. Thus, when the striking member 320 moves, the adapter 310 guides a movement such that the striking member 320 strikes the blocking member 112 of the pressure tank 110.

Moreover, the adapter 310 has a spraying part 312 to spray gas, which is sprayed when the striking member 320 strikes the blocking member 112 of the pressure tank 110, to an outside. Such a spraying part 312 is connected via the feeding tube to the buoyancy generator 180 (see FIG. 2), and is provided to introduce the sprayed gas into the buoyancy generator.

The striking member 320 is provided in the shape of a rod, is slidably inserted into the striking member slit 311 of the adapter 310, and is moved when the striking means is operated, thus striking the blocking member 112 of the pressure tank 110. Such a striking member 320 is preferably rounded at one end that strikes the blocking member 112 of the pressure tank 110.

The striking means is fastened to the adapter 310, and supplies power to move the striking member 320 and thereby render the striking member 320 to strike the blocking member 112 of the pressure tank 110.

In more detail, the striking means includes an elastic part 230 that is provided with an elastically moving cylinder 233, a strike transfer member 240 that is slidably inserted into the elastic part 230 and is triggered by the elastic part 230 to strike and move the striking member 320, and a trigger part 250 that is disposed between the elastic part 230 and the adapter 310, presses and constrains the strike transfer member 240 so that the strike transfer member 240 elastically compresses the cylinder 233, and selectively operates and releases the constraining force of the strike transfer member 240, thus triggering the strike transfer member 240.

Furthermore, the elastic part 230 includes an elastic-part body 231 that has a hollow portion and is open at one side thereof, a cap member 232 that is fastened at one side thereof to the open side of the elastic-part body 231, is fastened at the other side thereof to one side of the trigger part 250 and has a strike-transfer-member slit 232*a* at a center so that the strike transfer member 240 is movably inserted into the cap member, a cylinder 233 that is slidably disposed in the elastic-part body 231 and has a protrusion 233*a* protruding from one side of the cylinder and inserted into the strike-transfer-member slit 232*a* of the cap member 232, and an elastic member 234 that is disposed between the elastic-part body 231 and the cylinder 233 and applies an elastic force so that the cylinder 233 moves towards the cap member 232.

The trigger part 250 includes a trigger-part body 251 that is penetrated at a center thereof, is fastened at one side thereof to the elastic part 230 and is fastened at the other side thereof to the adapter 310, a rotary member 252 that is inserted into the trigger-part body 251 to be perpendicular to the strike transfer member 240 and is rotatably fastened, and has a through hole 252*a* to allow the strike transfer member 240 to pass therethrough, and a drive motor 253 that is provided on the trigger-part body 251 to rotate the rotary member 252.

Here, if the rotary member 252 rotates at a predetermined angle, the through hole 252*a* is located to make the striking member slit 311 communicate with the strike-transfer-member slit 232*a*. If the rotary member 252 rotates at a predetermined angle again, the through hole 252*a* is located to isolate the striking member slit 311 from the strike-transfer-member slit 232*a*.

That is, if the drive motor 253 is operated to rotate the rotary member 252 in the state where the rotary member 252 isolates the striking member slit 311 from the strike-transfer-member slit 232*a*, so that the through hole 252*a* of the rotary member 252 is located to cause the striking member slit 311 to communicate with the strike-transfer-member slit 232*a*, the strike transfer member 240 is triggered from the strike-transfer-member slit 232*a* and passes through the through hole 252*a* of the rotary member 252, thus striking the striking member 320.

Although not shown in the drawings, the device may further include a controller (not shown) that operates the drive motor 253 when a strike command is input. In this regard, the strike command may be transmitted to the controller through wireless communication.

In such a configuration, the cap member 232 is fastened to the trigger-part body 251 in the state where the strike transfer member 240 is inserted into the strike-transfer-member slit 232*a* of the cap member 232. Here, the through hole 252*a* of the rotary member 252 is rotated to a location where the striking member slit 311 is isolated from the strike-transfer-member slit 232*a*, so that the strike transfer member 240 is pressed against the rotary member 252 and the strike transfer member 240 presses the cylinder 233, thus compressing the elastic member 234 and thereby generating a compressive elastic force.

After the adapter 310 is fastened to the trigger-part body 251 and the striking member 320 is inserted into the striking member slit 311 of the adapter 310, the adapter 310 is fastened to the inlet 111 of the pressure tank 110, so that the striking part 200 is mounted on the pressure tank 110, as illustrated in FIG. 12.

In such a state, if the strike command is input, the controller actuates the drive motor 253 and the rotary member 252 is rotated by the drive motor 253, as illustrated in FIG. 13, so that the through hole 252*a* of the rotary member 252 is located to make the striking member slit 311 communicate with the strike-transfer-member slit 232*a*. Then, the strike transfer member 240 is released, so that the strike transfer member 240 is triggered by the elastic force, and the strike transfer member 240 strikes the striking member 320. The striking member 320 strikes the blocking member 112 of the pressure tank 110, thus spraying high-pressure gas stored in the pressure tank 110.

Figure 14:
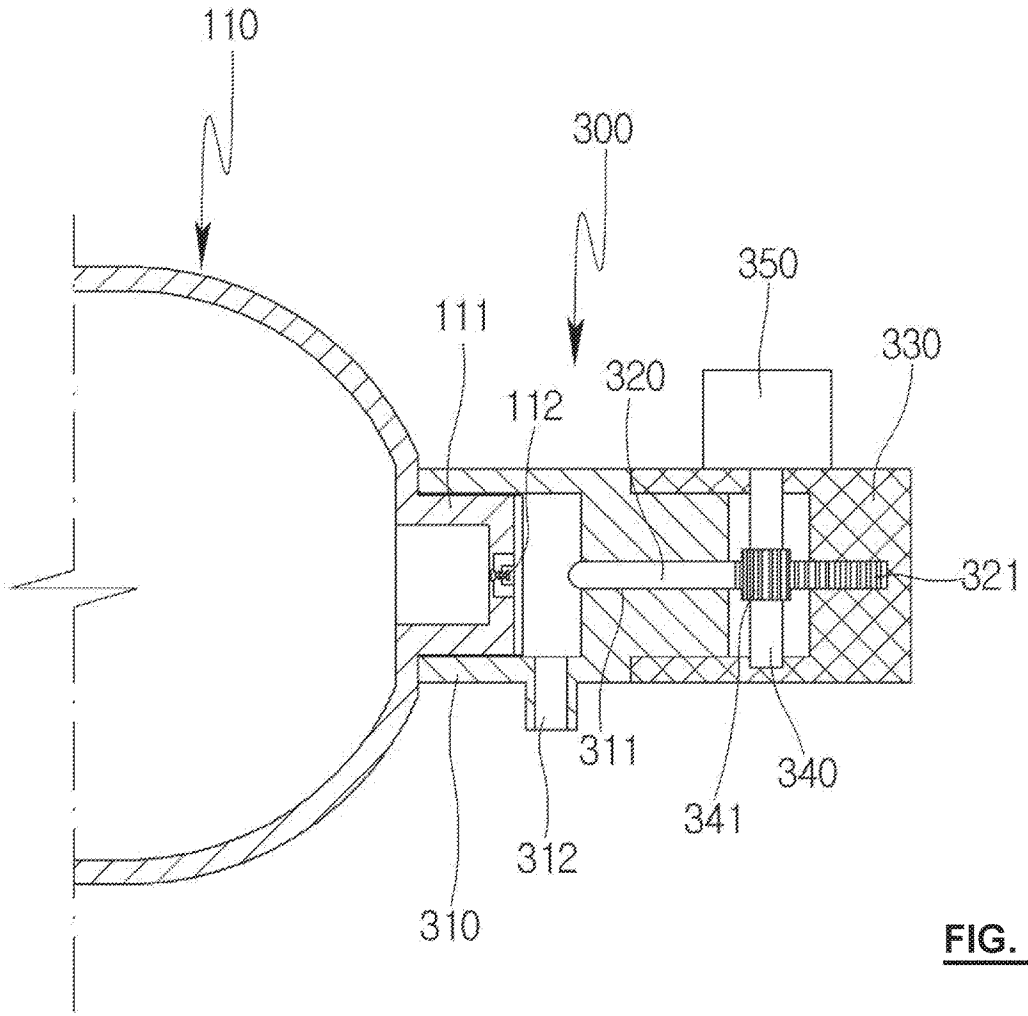
FIG. 14 is a sectional view schematically illustrating a state in which a striking part of a further embodiment on the floating recovery device for the underwater equipment according to the embodiment of the present invention is fastened to the pressure tank.
Figure 15:
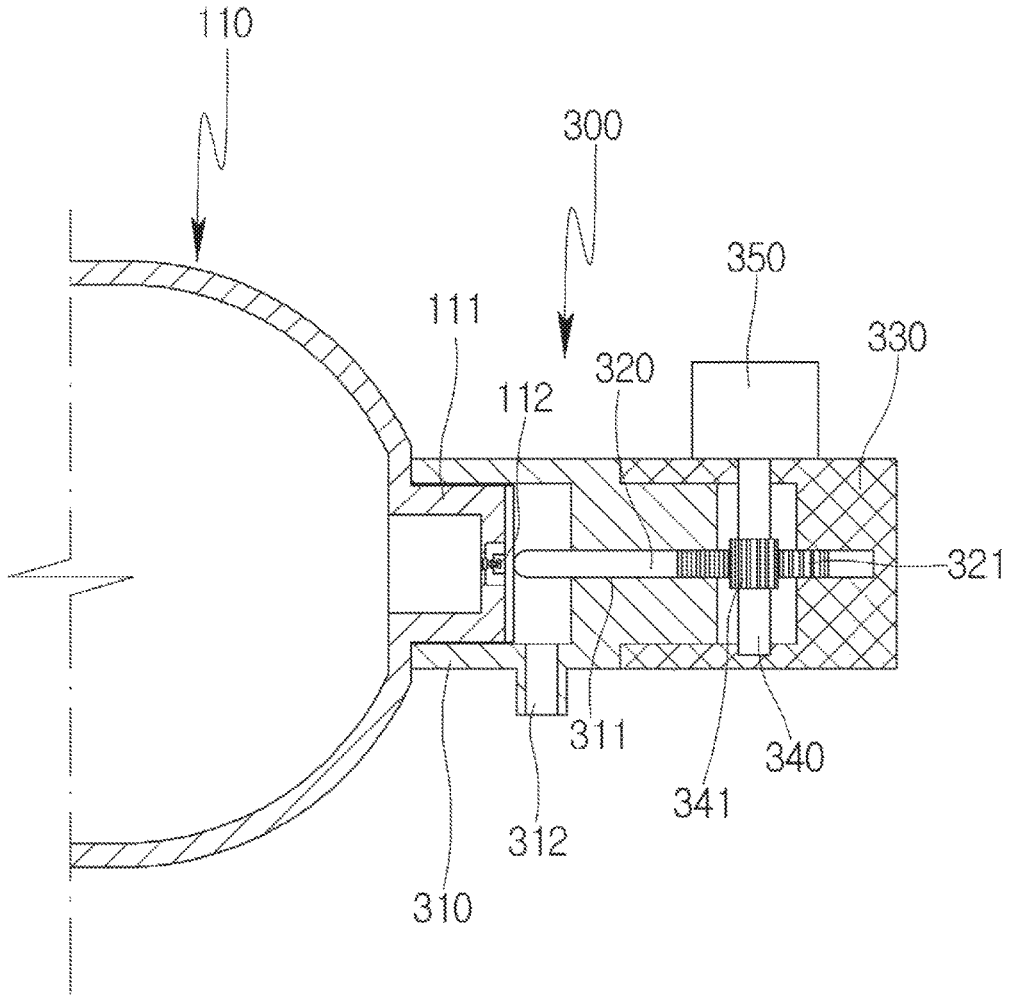
FIG. 15 is a sectional view schematically illustrating a state in which a striking part of a further embodiment on the floating recovery device for the underwater equipment according to the embodiment of the present invention is fastened to the pressure tank and then is operated.

FIGS. 14 and 15 are sectional views schematically illustrating a state in which a striking part of a further embodiment on the floating recovery device for the underwater equipment according to the embodiment of the present invention is fastened to the pressure tank and a state in which the striking part is operated.

Referring to FIGS. 14 and 15, the striking part 300 according to the further embodiment of the present invention includes an adapter 310 that is fastened to the inlet of the pressure tank 110 spraying stored high-pressure gas if the blocking member 112 is struck, a striking member 320 that is slidably inserted into the adapter 310 and strikes the blocking member 112 of the pressure tank 110, and a striking means that is fastened to the adapter 310 and moves the striking member 320 to strike the blocking member 112 of the pressure tank 110.

The adapter 310 is provided in the shape of a cylinder that is penetrated at a center thereof. One side of the adapter 310 is fastened to the inlet 111 of the pressure tank 110 in a screw-type fastening manner, while the other side is fastened to the striking means.

The adapter 310 has at a center thereof a striking member slit 311 so that the striking member 320 is movably inserted into the adapter. Thus, when the striking member 320 moves, the adapter 310 guides a movement such that the striking member 320 strikes the blocking member 112 of the pressure tank 110.

Moreover, the adapter 310 has a spraying part 312 to spray gas, which is sprayed when the striking member 320 strikes the blocking member 112 of the pressure tank 110, to an outside. Such a spraying part 312 is connected via the feeding tube to the buoyancy generator 180 (see FIG. 2), and is provided to introduce the sprayed gas into the buoyancy generator.

The striking means includes a housing 330 that is fastened to the adapter 310, a power transfer member 340 that is inserted into the housing 330 to be perpendicular to the striking member 320, is rotatably fastened thereto, and has a second gear 341 to engage with a first gear 321 formed on the striking member 320 to rectilinearly move the striking member 320, and a drive motor 350 that is provided on the housing 330 to rotate the power transfer member 340.

The striking member 320 is provided in the shape of a rod, is slidably inserted into the striking member slit 311 of the adapter 310, and is moved when the striking means is operated, thus striking the blocking member 112 of the pressure tank 110. Such a striking member 320 is preferably rounded at one end that strikes the blocking member 112 of the pressure tank 110.

The first gear 321 is formed on the other side of the striking member 320 and engages with the second gear 341 formed on the power transfer member 340 to rectilinearly move the striking member 320.

For example, as illustrated in FIGS. 14 and 15, the first gear 321 formed on the striking member 320 is provided as a rack gear, and the second gear 341 formed on the power transfer member 340 is provided as a pinion gear, so that the pinion gear rotates to rectilinearly move the rack gear, thus rectilinearly moving the striking member 320. Of course, the first and second gears may have any structures, for example, a worm gear, as long as it is possible to rectilinearly move the striking member 320, without being limited to the rack gear and the pinion gear.

In such a configuration, if the drive motor 350 generates rotating power, the power transfer member 340 is rotated. Thereby, while the second gear 341 rotates, it rectilinearly moves the first gear 321, the striking member 320 strikes the blocking member 112 of the pressure tank 110, thus spraying high-pressure gas stored in the pressure tank 110.

As described above, the present invention provides a floating recovery device for underwater equipment, in which a user wirelessly strikes a pressure tank to supply high-pressure gas to a buoyancy generator when expensive underwater equipment is lost in the water, thus floating the underwater equipment on the surface of water and allowing the equipment to be easily found.

While the present invention has been described with respect to the specific embodiments, it will be apparent to those skilled in the art that various changes and modifications may be made without departing from the spirit and scope of the invention as defined in the following claims.

What is claimed is:

1. A floating recovery device for underwater equipment, comprising:

a recovery body partitioned into a first compartment, a second compartment, and a third compartment by a partition wall;

first and second pressure tanks installed in the first and second compartments, respectively;

first and second striking parts fastened to the first and second pressure tanks, respectively, to strike the first and second pressure tanks;

first and second actuators wirelessly actuating the first and second striking parts, respectively; and a buoyancy generator installed in the third compartment, the buoyancy generator being inflated by high-pressure gas introduced from the first and second pressure tanks, thus generating buoyancy, wherein the second actuator comprises:

a second transmitter wirelessly sending an actuating signal in response to a user's operation;

a second receiver provided in the second compartment to receive a signal from the second transmitter;

a second controller receiving a signal from the second receiver;

a second power supply driven by the second controller;

a lighting part supplied with electric power from the second power supply to emit light; and a light sensor detecting light emitted from the lighting part and transmitting a signal to the second controller, wherein the second controller controls the second power supply in response to the signal transmitted from the light sensor, thus supplying electric power to the second striking part and thereby actuating the second striking part.

2. The floating recovery device according to claim 1, wherein the recovery body comprises:

a seal inserted into a sealing groove formed in tops of the first compartment, the second compartment, and the third compartment; and a recovery cover fastened to a top of the recovery body to compress the seal.

3. The floating recovery device according to claim 1, wherein the recovery body comprises:

a buoyancy generating outlet formed through a sidewall of the third compartment;

a withdrawal door fastened to the third compartment via a hinge to open or close the buoyancy generating outlet; and a support spring connecting the withdrawal door with a support protrusion formed in the third compartment, and applying an elastic force to cause the withdrawal door to be closed.

4. The floating recovery device according to claim 1, wherein the striking part comprises:

a striking body fastened at a first side thereof to the pressure tank;

a striking head disposed in the first side of the striking body, with a guide groove being formed in the striking head;

a striking pin inserted into the guide groove of the striking head to rectilinearly move, and striking a blocking member of the pressure tank;

a safety spring disposed between the guide groove and the striking pin, and applying an elastic force so that the striking pin is spaced apart from the blocking member;

a pushing link moving the striking pin to strike the blocking member of the pressure tank; and a solenoid part driving the pushing link.

5. The floating recovery device according to claim 4, wherein the solenoid part comprises:

a housing provided in a second side of the striking body;

a rod slidably disposed in the housing, and connected with the pushing link to actuate the pushing link;

a coil disposed to surround the rod, and generating a magnetic field to slidably move the rod if electric power is applied thereto; and a spring disposed between the housing and the rod, and applying an elastic force such that the rod actuates the pushing link and returns the pushing link to an original position thereof.

6. The floating recovery device according to claim 1, wherein the striking part comprises:

an adapter fastened to an inlet of the pressure tank;

a striking member slidably inserted into the adapter, and striking the blocking member of the pressure tank; and striking means fastened to the adapter, and moving the striking member to strike the blocking member of the pressure tank.

7. The floating recovery device according to claim 6, wherein the adapter is fastened at a first side thereof to the inlet of the pressure tank and is fastened at a second side thereof to the striking means, and a striking member slit is formed in a center of the adapter to allow the striking member to be movably inserted therein.

8. The floating recovery device according to claim 7, wherein the adapter further comprises:

a spraying part spraying gas, jetted when the striking member strikes the blocking member of the pressure tank, to an outside.

9. The floating recovery device according to claim 6, wherein the striking means comprises:

an elastic part having an elastically moving cylinder;

a strike transfer member slidably inserted into the elastic part, and triggered by the elastic part, thus striking and moving the striking member; and a trigger part disposed between the elastic part and the adapter, pressurizing and constraining the strike transfer member so that the strike transfer member elastically compresses the cylinder, and optionally actuated to release a constraining force from the strike transfer member.

10. The floating recovery device according to claim 9, wherein the elastic part comprises:

an elastic-part body having a hollow portion, and opened at a first side thereof;

a cap member fastened at a first side thereof to the open first side of the elastic-part body, and fastened at a second side thereof to a first side of the trigger part, with a strike-transfer-member slit being formed in a center of the cap member to allow the strike transfer member to be movably inserted therein;

a cylinder slidably disposed in the elastic-part body, a protrusion protruding from a first side of the cylinder to be inserted into the strike-transfer-member slit of the cap member; and an elastic member disposed between the elastic-part body and the cylinder, and applying an elastic force so that the cylinder moves towards the cap member.

11. The floating recovery device according to claim 9, wherein the trigger part comprises:

a trigger-part body penetrated at a center thereof, fastened at a first side thereof to the elastic part and fastened at a second side thereof to the adapter;

a rotary member rotatably inserted into and fastened to the trigger-part body to be perpendicular to the strike transfer member, with a through hole formed in the rotary member so that the strike transfer member passes therethrough; and a drive motor provided in the trigger-part body to rotate the rotary member.

12. The floating recovery device according to claim 6, wherein the striking means comprises:

a housing fastened to the adapter;

a power transfer member rotatably inserted into and fastened to the housing to be perpendicular to the striking member, and having a second gear that engages with a first gear formed on the striking member to rectilinearly move the striking member; and a drive motor provided in the housing to rotate the power transfer member.

13. The floating recovery device according to claim 6, further comprising:

a controller actuating a drive motor of the striking means if a strike command is input thereto.

* * * * *